US006234818B1

(12) United States Patent
Chun Te

(10) Patent No.: US 6,234,818 B1
(45) Date of Patent: May 22, 2001

(54) STATIC ELECTRICITY REMOVING DEVICE FOR A SIGNAL ANTI-THEFT CONNECTOR

(76) Inventor: Lee Chun Te, No.98-1 Lane Chiu She Beei., Twen Chu Taichung (TW)

( * ) Notice: Subject to any disclaimer, the term of this patent is extended or adjusted under 35 U.S.C. 154(b) by 0 days.

(21) Appl. No.: 09/434,136

(22) Filed: Nov. 5, 1999

(51) Int. Cl.[7] ..... H01R 13/62
(52) U.S. Cl. ..... 439/304; 333/172
(58) Field of Search ..... 439/304, 307, 439/620; 333/172, 181, 182, 183

(56) References Cited

U.S. PATENT DOCUMENTS 3,573,702 * 4/1971 O'Keefe ..... 338/220
4,972,505 * 11/1990 Isberg ..... 455/3
5,011,422 * 4/1991 Yeh ..... 439/307
5,106,312 * 4/1992 Yeh ..... 439/133

* cited by examiner

*Primary Examiner*—Lincoln Donovan
*Assistant Examiner*—Thanh-Tam Le
(74) *Attorney, Agent, or Firm*—Dougherty & Troxell

(57) ABSTRACT

A static electricity removing device for a signal anti-theft connector includes a protector, a metal inner connector contained in the protector, and an inner tube made of insulating plastic and having a chamber for receiving therein a capacitor connected to a resistor in series. The inner tube is fixed in the inner connector, and a lead of the capacitor or the resistor extends out of a hole in a first end, stabilized the capacitor and the resistor in the inner tube, to increase stability of image of wire television.

2 Claims, 3 Drawing Sheets

STATIC ELECTRICITY REMOVING DEVICE FOR A SIGNAL ANTI-THEFT CONNECTOR

BACKGROUND OF THE INVENTION

This invention relates to a structure of a signal connector (or distributor), particularly to one having a static electricity removing device for a signal anti-theft connector.

Conventional signal anti-theft connectors for wire television cables generally have a special structure or configuration in combination with a special tool in assembling or disassembling to prevent them from stolen or removed. As shown in FIG. 1, it is a common signal distributor 1 for wire television, provided with four plugs 2 for four customers to use. These plugs 2 are rather improved to have a metal cylindrical protector 3, which is secured tightly with the plug 2 by means of a nut. In carrying out assembling and disassembling, a special tool 4 has to be used, inserted in the protector 3 to rotate the nut. However, this kind of tool 4 is now very popularly used, quite limited in its preventive effect against theft.

Further, the plug 2 not used has static electricity to emit signal to interfere its own channel by feedback, giving negative impact to image. So some makers may add a resistor and a breaker, which may be troublesome to fix, and increase cost, not popular in use.

SUMMARY OF THE INVENTION

This invention has been devised to offer a static electricity removing device for a signal anti-theft connector (or distributor), having an inner tube for containing electronic components for removing static electricity and miscellaneous signals and easy to fix and handle.

The main feature of the invention is an inner tube for containing a capacitor connected to a resistor in series for removing static electricity of a plug of a signal distributor of a wire television so as to prevent interference to its own channel by feedback of signals and also to prevent a protector containing an inner connector in which the inner tube is fixed from illegally removed to stealthily connect the plug of the signal distributor.

BRIEF DESCRIPTION OF DRAWINGS

This invention will be better understood by referring to the accompanying drawings, wherein.

DETAILED DESCRIPTION OF THE PREFERRED EMBODIMENT

Figure 2:
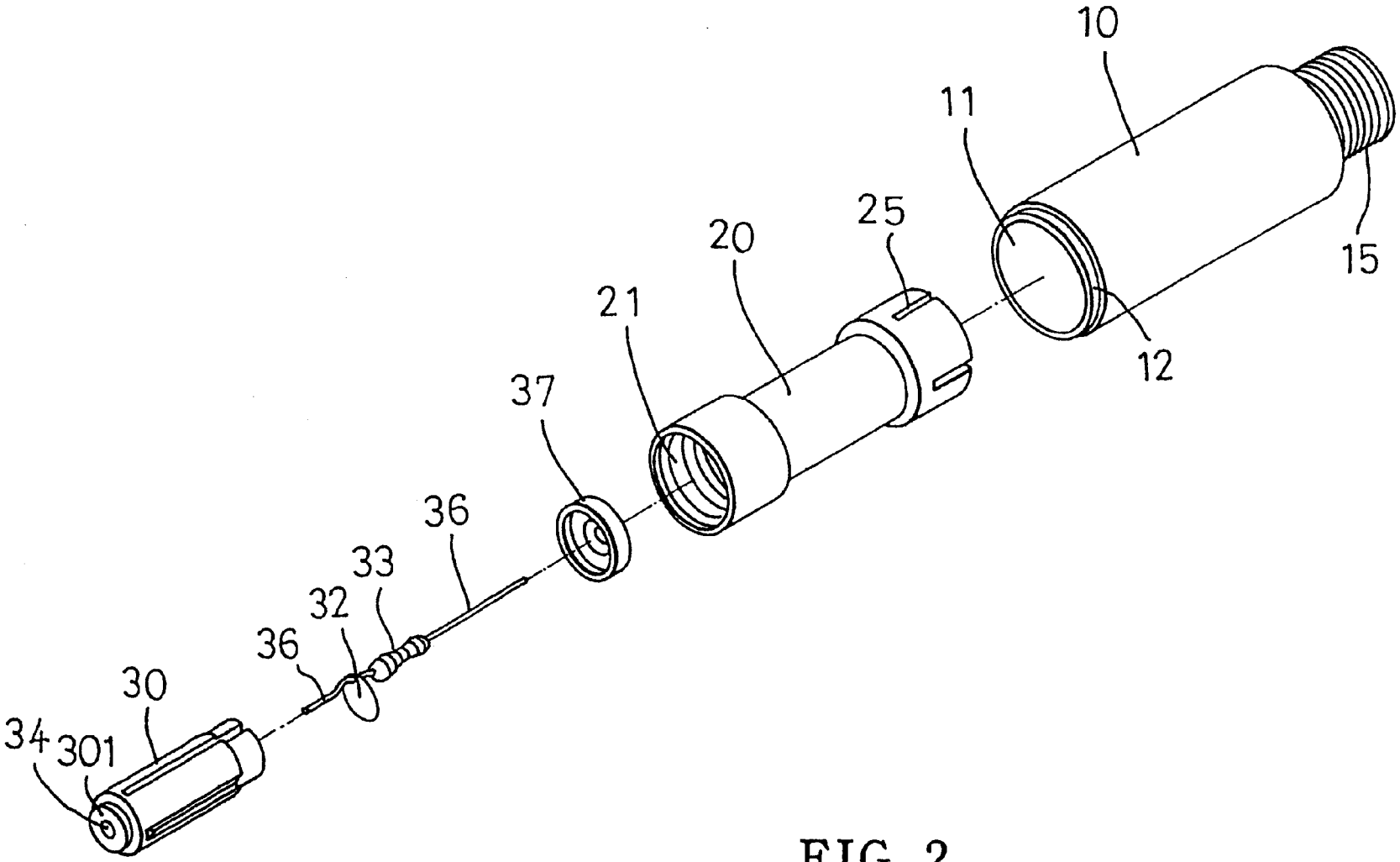
FIG. 2 is an exploded perspective view of a static electricity removing device for a signal anti-theft connector in the present invention.
Figure 3:
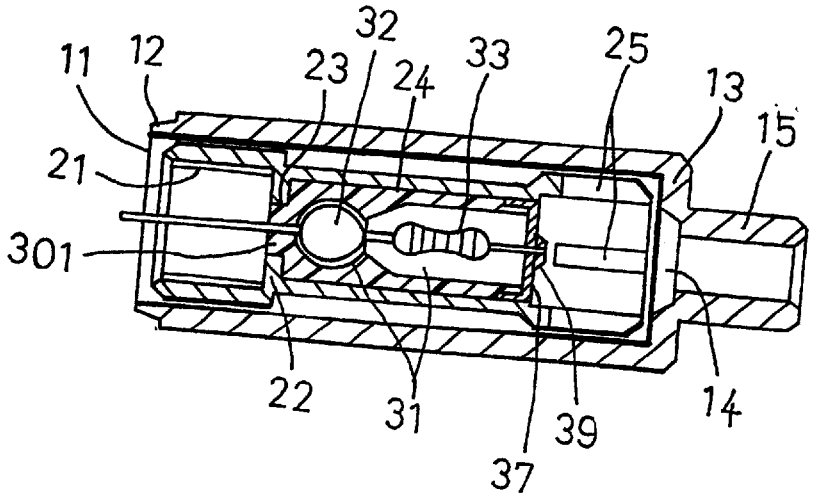
FIG. 3 is a cross-sectional view of the static electricity removing device for a signal anti-theft connector in the present invention; and, FIG. 4 is a partial cross-sectional perspective view of the static electricity removing device for a signal anti-theft connector in the present invention.
Figure 4:
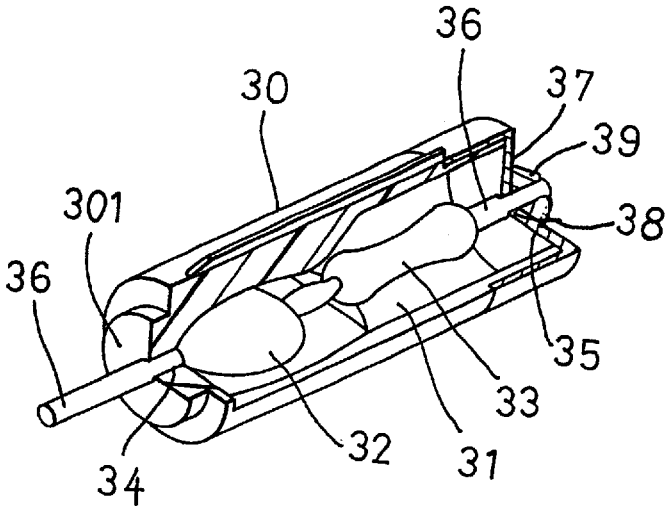

A preferred embodiment of a static electricity removing device for a signal anti-theft connector in the present invention, as shown in FIGS. 2, 3 and 4, includes a protector 10, an inner connector 20 and an inner tube 30 as main components combined together.

The protector 10 is cylindrical and made of a metal, having a mouth 11 formed in a first end for inserting other components, closed with a side plate 12 riveted on the mouth 11, a second end wall 13 bored with a small diameter hole 14, and a threaded circular wall 15 extending from the hole 14 outward for guiding illegal connection with no effect.

The inner connector 20 is cylindrical and made of a metal, located in the protector 10, having a threaded hole 21 in a first end for screwing with a plug 2 of a distributor 1, a vertical separating wall 22 formed in the interior, and a center hole 23 formed in the separating wall 22, a room 24 of a certain size formed in the interior, a plurality of lengthwise slots 25 spaced apart in a second end for a special wrench to engage with for rotating the inner connector 20 with a plug of an anti-theft connector (or distributor).

The inner tube 30 is made of an insulating material, as shown in FIG. 4, having a chamber 31 in the interior for receiving a capacitor 32 and a resistor 33 connected to each other in series therein. The chamber 31 is of a hollow saucer shape to for the capacitor 32 to rest stably in the chamber 31. A center hole 34 is bored in a first end for a metal wire to pass through, a mouth 35 formed in a second end, welded with a metal cap 37 having a center hole 38 for a lead 36 of the resistor 33 to pass through and welded at an outside side of the hole 38 to form a weld point 39. The welding point 39 conducts electricity to the cap 37, and secured the capacitor 32 and the resistor 33 as well.

In assembling, the capacitor 32 and the resistor 33 have to be inserted in the chamber 31 of the inner tube 30 and then welded stably therein. The conducting portion of the inner tube 30 is the cap 37 and the lead 36 at the first end, with the rest portion being a plastic insulating one.

As shown in FIG. 3, the inner tube 30 is inserted in the room 20 of the inner connector 20 stably, with a round projection 301 formed on the first end of the inner tube 30 fitting tightly in the center hole 23 of the separating wall 22. At the same time, the lead 36 extends out for a preset distance.

Next, the inner connector 20 is placed in the protector 10, with the side plate 12 is riveted to close up the mouth 11, permitting the inner connector 20 rotate, finishing assemblage of the static electricity removing device for a signal anti-theft connector.

Figure 1:
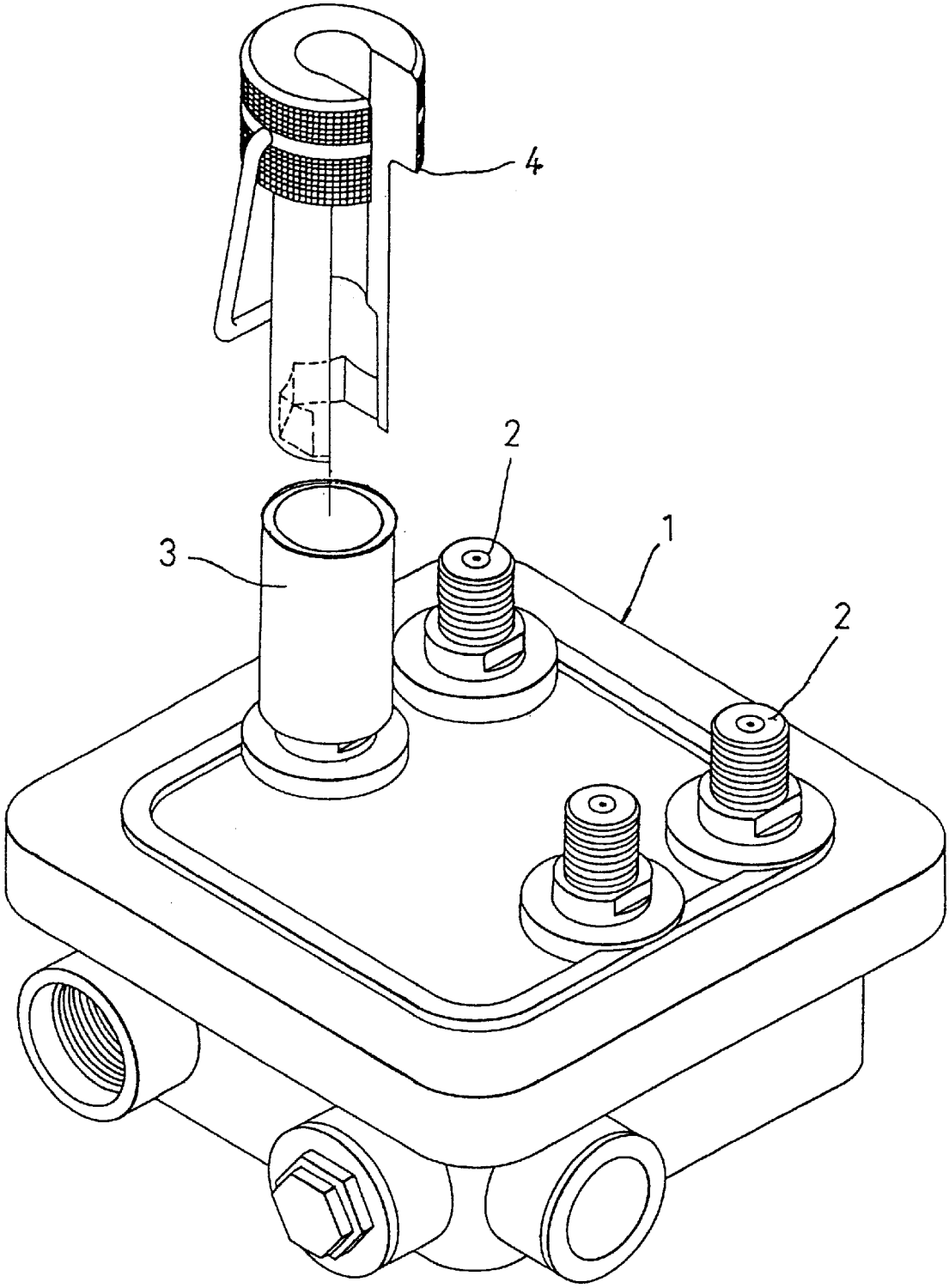
FIG. 1 is a perspective view of a known conventional distributor for wire television.

In using, a special wrench is used as that used in the known conventional one, inserted from the hole 14 of the protector 10 to engage with the slots 15. Align the end of the threaded hole 21 and the lead 36 to a plug 2 of the signal distributor 1 shown in FIG. 1, and rotate the special wrench to let the threaded hole 21 screw in further with the plug 2 stably, and pull out the wrench, finishing assemblage of the static electricity removing device. Then the lead 36 is inserted in the plug 2, connected to a main signal wire. The metal cap 37 at The metal cap 37 at the second end contacts with the metal inner connector 20, with the inner connector 20 screwed with the plug 2 to form a good grounding.

The protector 10 has a circular circumference with no points to be tampered with, and cannot be disengaged from the plug 2 without the special tool, surely preventing it from pried off for signals to be stolen from the plug 2.

Further, if the plug 2 not used is fixed with the static electricity removing device, the capacitor 32 can get rid of static electricity, and the resistor 33 can function to remove signals so that signals at the plug 2 not used may not interfere its own channel by feedback, keeping image stable.

In addition, the capacitor 32 has a hollow saucer shape to be stably positioned in the chamber 31 of the inner tube 30.

Further, the metal cap 37 fixed tightly on the mouth 35 and the lead 36 extending out of the center hole 38 make up good conduction, and also stabilize the capacitor 32 and the resistor 33 in their place.

While the preferred embodiment of the invention has been described above, it will be recognized and understood that various modifications may be made therein and the appended claims are intended to cover all such modifications which may fall within the spirit and scope of the invention.

What is claimed is:

1. A static electricity removing device for a signal anti-theft connector comprising: a protector having an open mouth in a first end and a hole in a second end; an inner connector fixed in said protector and having a threaded hole in a first end and a room in its interior:

an inner tube made of plastic, fixed in said room of said inner connector, having a chamber containing a capacitor connected to a resistor in series therein, a lead of one of said capacitor and resistor extending out of a hole of a first end of said inner tube, said inner tube having a second end with an open mouth closed by a metal cap, said metal cap having a center hole for said lead of one of said capacitor and resistor to pass through and being welded at an outside of said center hole to form a welded point.

2. The static electricity removing device for a signal anti-theft connector as claimed in claim 1, wherein said inner tube has said chamber provided with a hollow saucer shape for receiving said capacitor.

* * * * *